United States Patent [19]

Brink et al.

[11] 4,045,187

[45] Aug. 30, 1977

[54] CARBONACEOUS MATERIAL

[75] Inventors: Andries Brink; Adriaan Hendrikus Stander; Leonard James Dry, all of Sasolburg, South Africa

[73] Assignee: South African Coal, Oil & Gas Corporation Limited, Sasolburg, South Africa

[21] Appl. No.: 579,089

[22] Filed: May 20, 1975

[30] Foreign Application Priority Data

May 24, 1974 South Africa ..... 74/3325

[51] Int. Cl.[2] ..... C10L 9/00; C10G 1/00; C10B 51/00

[52] U.S. Cl. ..... 44/1 B; 201/25; 208/8

[58] Field of Search ..... 44/1 R, 1 B; 208/8; 201/21, 24

[56] References Cited

U.S. PATENT DOCUMENTS

| | | | |
|---|---|---|---|
| 1,704,792 | 3/1929 | Debo | 208/8 |
| 1,706,468 | 3/1929 | Struben | 208/8 |
| 1,794,865 | 3/1931 | Pier et al. | 208/8 |
| 1,925,005 | 8/1933 | Rose et al. | 44/1 R |
| 2,147,753 | 2/1939 | Pott et al. | 208/8 |
| 2,223,184 | 11/1940 | Pier et al. | 208/8 |
| 2,686,152 | 8/1954 | Franke | 208/8 |
| 3,933,443 | 1/1976 | Lohrmann | 44/1 C |

*Primary Examiner*—Carl F. Dees
*Attorney, Agent, or Firm*—Fred Wiviott

[57] ABSTRACT

A novel carbonaceous material derived from solid carbonaceous fossil fuel, in particular low rank coal, such as brown coal, having a low ash and sulphur content, is prepared by deoxygenation and dewatering in the presence of hydrogen and a solvent having hydrogen carrier properties (e.g. anthracene oil under conditions known per se for the solvent extraction of coal. The entire liqueform reaction product is distilled down without prior filtration and recovered as the product which, besides the soluble components also includes the ash and carbonaceous insolubles. The material which has a ring and ball softening point above 30° C, preferably above 100° C, is particularly useful for blending with coal having inferior coking properties in order to produce a coking blend useful for the production of metallurgical coke, applying conventional coking conditions.

20 Claims, No Drawings

CARBONACEOUS MATERIAL

BACKGROUND OF THE INVENTION

The present invention relates to a carbonaceous material derived from solid carbonaceous fossil fuel, subjected to deoxygenation, and where appropriate dewatering, in the presence of hydrogen and a solvent having hydrogen carrier properties.

In the so-called solvent refining of coal, which process can be applied to moderately high rank through to low rank coals, the coal, in a particulate condition, is subjected to liquefaction in a high-boiling solvent, (e.g. boiling between 200° and 450° C), suitable as a hydrogen carrier (in a physical and/or chemical sense), at a temperature above 350° C, say between 350° and 500° C in the presence of hydrogen, at a pressure of about 30 to 250 bar. After having been subjected to this treatment for about 15 to 120, more particularly 50 to 90 minutes, the pressure is let down from the reaction product and the liqueform reaction mixture is subjected to a step of solids separation, usually filtration, in order to remove therefrom all non-dissolved matter, namely the char-like solids such as fusain and the ash. The clear liquid phase is then subjected to distillation whereby the solvent is recovered and recycled, whereas the substantially non-volatile bottoms of the distillation constitute the so-called solvent refined coal (SRC) which can serve as a feed stock for catalytic hydro-cracking. The object of the solvent-refining of coal, of which the solids removal step has always been an integral and essential part, is the obtaining of a feed stock of low oxygen and sulphur content and substantially free of substances which can harm the catalyst physically or chemically in the subsequent hydro-cracking step. Where SRC is advocated as a fuel, its low ash and sulphur contents are invariably quoted as favourable characteristics, which can make an important contribution towards air pollution abatement. The comparatively difficult solids removal step is thus an important and essential part of the known processes between the separation of ash and carbonaceous insolubles harmful to the catalyst or for other purposes, is one of the primary objects of such processes.

Conventional solvent refined coal (an essential characteristic of which is the virtual absence of ash) is known to have properties making it suitable for coking purposes. We had also observed that by blending a relatively small proportion of SRC with a poorly coking coal, the coking properties of the coal are substantially upgraded. However, the comparatively high cost of conventional SRC has militated against its production on a commercial scale and hence its use for that purpose.

SUMMARY OF THE INVENTION

It is an object of the present invention to provide a novel product which can be manufactured by a comparatively simple process and which nevertheless has some of the valuable properties of SRC. The invention is particularly applicable in appropriate circumstances to the provision of a raw material for upgrading coals used in metallurgical coke production.

In accordance with the present invention a material as defined in the introductory paragraph consists of or comprises the combined, substantially non-volatile, substantially solid product and residues of said deoxygenation (and where appropriate dewatering), including ash and carbonaceous insolubles, the material having an R and B (ring and ball) softening point above 30° C. In practice this value is preferably above 100° C. Preferably the total char content (i.e., ash plus carbonaceous insolubles) is less than 12%, more preferably less than 8%. Preferably the actual ash content is not more than 10%, preferably not more than 7%, all by weight of dry solid matter.

Also preferably the product contains at the most 2% sulphur, preferably less than 0.5% sulphur (by weight).

The scope of the invention includes coking coal blends incorporating such product as above defined.

The scope of the invention is also intended to embrace coke manufactured from a material or blend in accordance with the invention as defined above, and the use of such coke for metallurgical purposes, e.g. for use in blast furnaces.

Also in accordance with the invention there is provided a process for the manufacture of a material as defined above, preferably of a coking coal blend starting material suitable for use in the production of metallurgical coal, which comprises subjecting a solid carbonaceous fossil fuel material containing preferably not more than 7%, more preferably not more than 4% by weight of ash, and preferably not more than 4%, more preferably not more than 2% by weight of sulphur, both based on solid dry matter, but of which the oxygen content is undesirably high, more particularly too high for satisfactory coking properties, to a step of deoxygenation and removal of such water as may be present, which step comprises heating the carbonaceous material in intimate contact with a liquid solvent and a hydrogen carrier and hydrogen under pressure to effect deoxygenation, followed by distilling the solvent and such volatiles as are formed off the combined product of said heating, and recovering the combined residue of such distilling as a product.

More preferably the said solid fuel material used as a starting material contains less than 2% of ash and preferably also less than 1% of sulphur, both based on solid dry matter. However, higher ash and sulphur contents may be acceptable, provided the final product meets the required specifications.

In order to guide the process towards the formation of solid products as defined in the aforegoing, principles are adopted which are known as such to those skilled in coal liquefaction, avoidance of very high pressures and temperatures and the avoidance of catalysts which are known to favour the formation of liquids.

The hydrogen carrier may be and preferably is provided by the solvent itself, more particularly by such solvent comprising hydroaromatic compounds.

It is also possible for the hydrogen carrier to be supplied wholly or in part by a non-volatile hydrogenation catalyst, which may be added to the system for that purpose, or may be present in the ash of the coal.

However, the presence of a catalyst is not an essential prerequisite.

The process may be carried out with technical hydrogen or with hydrogen-containing gas mixtures, such as industrial mixtures comprising hydrogen and carbon monoxide and steam, or mixtures which can generate hydrogen in situ, e.g. CO and water. When employing water gas or pressure generator gas, it is possible to but not necessary to remove $CO_2$ by scrubbing. It is also possible but not necessary to upgrade the hydrogen content by the shift reaction or purification.

By thus evaporating down the combined residual product, including carbonaceous insolubles and ash and, where appropriate, by selecting a starting material meeting the defined requirements, it becomes possible to bypass the difficult and expensive solids removal stage of SRC manufacture and produce a valuable product at reduced cost.

The preferred carbonaceous fossil fuel material for use in the process and material in accordance with the invention is a low rank coal having the defined characteristics, in particular a brown coal. Brown coal often has a very low ash and sulphur content, rendering it particularly suitable for the present purposes. The invention also envisages the use of suitable peat for the process.

The conditions of the deoxygenation stage may be substantially as employed in the manufacture of SRC. Thus, the liquid solvent and hydrogen carrier may be one of the high-boiling solvents used in the manufacture of SRC, more particularly a hydro-aromatic liquid boiling between 200° and 450° C. Creosote fractions, if necessary suitably processed for the purpose, may be used. Appropriate coke oven or coal pyrolysis tar fractions or coal gasification fractions such as the anthracene oil fraction or similar fractions may be employed. The aromatic extract from lubrication oil refining may also be employed after suitable pre-treatment, in particular partial hydrogenation.

As in the manufacture of SRC the solvent is employed in an amount sufficient to form a slurry. Solvent-/coal ratios can vary from less than 0,5 to more than 5,0 but fall preferably in the range between 1 and 3. The preferred temperature during the deoxygenation stage is above 350° C and below 500° C, preferably between 400° and 450° C, say 430° C. The hydrogen pressure can be between 30 and 250 bar, preferably between 70 and 200, say 140 bar. It will be appreciated that higher temperatures can be employed if the pressures are higher, provided the formation of liquid products is sufficiently suppressed.

The process for making the said carbonaceous material may be carried out batch-wise or on a continuous basis.

Also in accordance with the invention there is provided a process for making coke, suitable for metallurgical purposes, wherein the carbonaceous material in accordance with the invention, more particularly the product of the aforesaid process in accordance with the invention, is subjected in the form of a blend to coking, more particularly under commonly known coking conditions.

Furthermore there is provided, in accordance with the invention, a process for the making of a coking coal blend, wherein the carbonaceous material in accordance with the invention, more particularly produced as described above, is blended with other suitable carbonaceous matter having comparatively inferior coking properties, in order to form a blend having comparatively improved and adequate coking properties.

The material in accordance with the invention can also be used as a fuel per se or in blends, being substantially upgraded as compared with the starting material. In appropriate circumstances it can also be used as a feed stock for processing to fuels or petrochemicals and their precursors.

DESCRIPTION OF SPECIFIC EXAMPLES

Example 1

A brown coal was used having the following analysis (all figures in mass percent).

Ash: 1,0
Moisture: 10,1
Carbon: 60,3
Hydrogen: 4,0
Nitrogen: 0,5
Sulphur: 0,25
Oxygen: 23,9.

500 g of this material was ground to a particle size less than 100 mesh and slurried with 1000 g of tetralin.

This slurry was heated in an autoclave with agitation for 75 minutes at 420° C, hydrogen being introduced at a pressure of 90 bars, (initial pressure). No catalyst was employed.

At the end of that period the pressure was let down and the slurry was fed directly into a distillation apparatus and subjected to distillation under partial vacuum to a cut point of 420° C at 760 mm Hg.

The residue was a brittle, shiny black, solid material having the following composition (in mass percent):

Ash: 2,0
Moisture: 0
Carbon: 86,2
Hydrogen: 5,9
Nitrogen: 0,5
Sulphur: 0,07
Oxygen: 5,4.

The yield was about 50 mass percent based on the original coal.

EXAMPLE 2

From the residue obtained in Example 1 a blend is prepared as follows:

The brown coal extract was crushed and added in amounts of 5% and 10% two coals, one of them with no coking properties and the other a good coking coal. The coking propensities of the mixtures were then characterised by means of Roga Index and Dilatometer determinations.

| | Roga Index | % Dilatation |
|---|---|---|
| Coal A | 24 | − 15 |
| + 5% BCE* | 29 | − 12 |
| + 10% BCE* | 35 | − 5 |
| Coal B | 55 | 50 |
| + 5% BCE* | 56 | 90 |
| + 10% BCE* | 61 | 139 |

*BCE = Brown Coal extract

It is clear that the addition of the brown coal extract has a beneficial effect on the coking properties of a coal and that the coke produced from the appropriate blends will be suitable for metallurgical purposes.

What we claim is:

1. A coking blend, which when subjected to conventional coking conditions is converted to a coke useful for metallurgical purposes, said blend consisting essentially of:

i. up to about 10% by weight of a carbonaceous material derived from solid carbonaceous fossil fuel, subjected to deoxygenation and dewatering in the presence of hydrogen and a solvent having hydrogen carrier properties which consists essentially of the combined, substantially non-volatile, substantially solid product and residues of said deoxygenation, including ash and carbonaceous insolubles, the material having a ring and ball softening point about 30° C, and ii. the balance of said blend consisting of coal having coking properties inadequate for metallurgical purposes.

2. A blend as claimed in claim 1 wherein from 5 to 10% by weight of said carbonaceous material is employed in said blend.

3. A blend as claimed in claim 1 wherein the total char content of said carbonaceous material is less than 12% by weight of dry solid matter.

4. A blend according to claim 3 wherein said total char content is less than 8% by weight of dry solid matter.

5. A blend according to claim 1 wherein the actual ash content of the said carbonaceous material is not more than 10% by weight of the dry solid matter of the carbonaceous material.

6. A blend according to claim 5 wherein said actual ash content is not more than 7% by weight of said dry solid matter.

7. A blend according to claim 1 wherein the carbonaceous material is derived from brown coal.

8. A blend according to claim 1 wherein said carbonaceous material contains at the most 2% sulphur by weight of dry solid matter.

9. A blend according to claim 8 wherein said carbonaceous material contains less than 0.5% sulphur by weight of dry solid matter.

10. A blend according to claim 1 wherein said carbonaceous material has a ring and ball softening point about 100° C.

11. A process for the manufacture of coke useful for metallurgical purposes, which consists essentially of:

i. preparing a carbonaceous residue by subjecting a solid carbonaceous fossil fuel material of which the oxygen content is undersirably high for satisfactory coking properties to a step of deoxygenation and removal of such water as may be present, which step comprises heating the carbonaceous material in intimate contact with a liquid solvent and a hydrogen carrier and hydrogen under pressure to effect the deoxygenation, followed by distilling the solvent and such volatiles as are formed off the combined product of said heating, and recovering the combined residue, ii. blending up to about 10% by weight of the carbonaceous material produced by step (i) with ordinary coal having coking properties unsatisfactory for metallurgical purposes, and iii. subjecting the blend of step (ii) to conventional coking conditions and recovering the resulting coke as a product.

12. The process according to claim 11 wherein about 5 to 10% by weight of the said carbonaceous material is employed in step (ii).

13. The process according to claim 11 wherein said solid carbonaceous fossil fuel material contains not more than 7% by weight of ash and not more than 4% by weight of sulphur.

14. The process according to claim 13 wherein said fuel material is selected with an ash content of not more than 4% by weight.

15. The process according to claim 11 wherein step (i) is carried out with a technical gas mixture containing hydrogen.

16. The process according to claim 15 wherein said gas mixture is water gas or pressure generator gas.

17. The process according to claim 11 wherein said fuel material is selected with an ash content of less than 2% of ash and less than 1% of sulphur, both based on solid dry matter.

18. The process according to claim 11 wherein a low rank coal is used as the fossil fuel material.

19. The process according to claim 18 wherein the low rank coal is a brown coal.

20. The process according to claim 11 wherein the conditions of the deoxygenation stage are substantially as employed in the manufacture of SRC.

* * * * *